US006677844B1

(12) United States Patent
Gorospe et al.

(10) Patent No.: US 6,677,844 B1
(45) Date of Patent: Jan. 13, 2004

(54) QUICK-RETURN ELECTRO-MECHANICAL ACTUATOR

(75) Inventors: Archimedes B. Gorospe, West Jordan, UT (US); Charles Pearson, Salt Lake City, UT (US)

(73) Assignee: Adams Rite Aerospace, Inc., Fullerton, CA (US)

( * ) Notice: Subject to any disclaimer, the term of this patent is extended or adjusted under 35 U.S.C. 154(b) by 0 days.

(21) Appl. No.: 10/274,558

(22) Filed: Oct. 21, 2002

(51) Int. Cl.[7] ..... H01F 7/08

(52) U.S. Cl. ..... 335/220; 335/259; 335/268; 70/277

(58) Field of Search ..... 335/259, 267, 335/268, 220; 70/277–279

(56) References Cited

U.S. PATENT DOCUMENTS 2,935,663 A * 5/1960 Pollak ..... 335/259
4,081,774 A * 3/1978 Barrett et al. ..... 335/228
4,540,965 A * 9/1985 Hattori et al. ..... 335/259
4,546,955 A * 10/1985 Beyer et al. ..... 251/129.15
4,656,850 A * 4/1987 Tabata ..... 70/276
4,681,143 A * 7/1987 Sato et al. ..... 137/625.37
4,697,164 A * 9/1987 Eilertsen ..... 335/253
4,931,758 A * 6/1990 Bagalini ..... 335/174
5,200,728 A * 4/1993 Patterson et al. ..... 335/223
5,339,662 A * 8/1994 Goldman ..... 70/277
5,422,617 A * 6/1995 Brown ..... 335/267
6,098,433 A * 8/2000 Maniaci ..... 70/278.1
2002/0145494 A1 * 10/2002 Andoh ..... 335/126

* cited by examiner

*Primary Examiner*—Lincoln Donovan
*Assistant Examiner*—Bernard Rojas
(74) *Attorney, Agent, or Firm*—Baker & Hostetler LLP

(57) ABSTRACT

A quick-return electro-mechanical actuator (20) broadly includes a cocking solenoid (21) and a holding solenoid (22). Each of the solenoids has an armature (24, 31) and a rod (26, 33). The rods are adapted to contact one another when the actuator is energized. However, after the second rod has been moved to its extended position, the cocking coil is de-energized. The mass of the first rod and first armature is thereafter uncoupled and separated from the mass of the second rod and second armature such that when the second coil is subsequently de-energized, a spring (35) will expand to quickly move the second rod from its extended position to its retracted position

18 Claims, 3 Drawing Sheets

QUICK-RETURN ELECTRO-MECHANICAL ACTUATOR

TECHNICAL FIELD

The present invention relates generally to a quick-return electro-mechanical actuator, and, more particularly, to an improved tandem solenoid arrangement that is well suited for use in securing the cockpit door in a commercial aircraft and that offers the feature of quick return and release when it is desired to unlock the door.

BACKGROUND ART

A cockpit door lock solenoid is an electro-mechanical device designed for selectively locking and unlocking a commercial aircraft cockpit door. In addition to enabling a pilot to remotely lock and unlock the cockpit door for security reasons, such a door lock mechanism must be designed to unlock within three milliseconds when electronically triggered by a sensor detecting decompression in the cockpit and/or cabin. Otherwise, the differential pressure across the door may preclude the door from being opened.

Since the events of Sep. 11, 2001, cockpit door lock solenoids have been mandated on a wide variety of commercial aircraft to provide security to the cockpit.

It would be generally desirable to provide an improved quick-return electro-mechanical actuator that is distinguished from other solenoid-type mechanisms by a quick-return feature and by low-power consumption, which reduces the amount of generated heat, during continuous duty cycles.

Details of various prior art tandem-operated solenoids, albeit not necessarily applied to securing cockpit doors, are shown and described in one or more of the following U.S. Pat. Nos: 6,427,811, 4,639,700, 4,548,408, 4,366,564, 4,191,248, 4,103,120, 3,736,054 and 3,275,964.

Accordingly, it would be generally desirable to provide an improved electro-mechanical actuator that offers the capability of a long actuation stroke, a quick return upon the occurrence of a sensed-condition (e.g., cockpit and/or cabin depressurization, etc.), and reduced power consumption and reduced heat generation when held in a cocked position for a long period of time.

DISCLOSURE OF THE INVENTION

With parenthetical reference to the corresponding parts, portions or surfaces of the disclosed embodiment, merely for purposes of illustration and not by way of limitation, the present invention broadly provides an improved quick-return electro-mechanical actuator (20).

In one aspect, the improved actuator broadly includes a cocking solenoid (21) having a first body (23), a first armature (24) movably mounted on the first body, and a first coil (25) mounted on the first body and adapted to be selectively energized to cause the first armature to move between return and cocked positions; a first rod (26) movably mounted on the first body for movement with said first armature; a first spring (29) operatively arranged to urge the first rod and first armature to move toward such return position; a holding solenoid (22) having a second body (30), a second armature (31) movably mounted on the second body for movement between retracted and extended positions, and a second coil (32) mounted on the second body and adapted to be selectively energized to hold the second armature in its extended position; a second rod (33) mounted on the second body for movement with the second armature; a second spring (35) operatively arranged to urge the second rod and second armature to move toward the retracted position; and a control circuit (36) selectively operable to energize the first and second coils to move the first armature to its cocked position and to move the second armature to its extended position, and to de-energize the first coil when the second armature is held in its extended position; whereby, when the first coil is de-energized, the first spring may expand to move the first armature back toward its return position such that the mass of the second armature will be separated from the mass of the first armature so that when the second coil is subsequently de-energized, the second spring will expand to quickly move the second rod from its extended position toward its retracted position.

In another aspect, the invention provides a quick-return electro-mechanical actuator (20), comprising: an actuating member (33) having a range of motion between a retracted position and an extended position; a return spring (35) operatively arranged to urge the actuating member toward the retracted position; a cocking solenoid (21) selectively energizable to move the actuating member from its retracted position to its extended position; a unidirectional coupling (24,26,29) between the cocking solenoid and the actuating member for urging the cocking solenoid to separate from said actuating member when said cocking solenoid is de-energized so as to subsequently allow independent motion of the actuating member; and a holding solenoid (22) selectively energizable to hold the actuating member in the extended position after the cocking solenoid has been de-energized and the cocking solenoid has separated from the actuating member such that the return spring may quickly accelerate the actuating member from its extended position toward its retracted position without any further displacement of the cocking solenoid or the coupling when the holding solenoid is subsequently de-energized.

In the disclosed embodiment, the cocking and holding solenoids are structural different so as to adapt each to its stated function. The cocking and holding solenoids have magnetic circuits that are independent of one another. In other words, they have separate and non-overlapping paths of magnetic flux. The cocking solenoid may have a magnetic circuit (42) that includes a fixed-reluctance radial air gap (43') and a variable-reluctance axial air gap (43) arranged in series with one anther. The axial air gap of the cocking solenoid may be defined between facing frusto-conical surfaces.

The holding solenoid may have a magnetic circuit (49) that includes two variable-reluctance axial air gaps (51,51) arranged in series with one another. The holding solenoid magnetic circuit may not include a fixed-reluctance radial air gap.

In the disclosed embodiment, the mass of the first armature is greater, and perhaps substantially greater, than the mass of the second armature. The spring rate of the second spring may be, and preferable is, substantially greater than the spring rate of the first spring.

The first body may have a surface that functions as a stop for movement of the first armature. The first spring may act against the first body, and the second spring may act against the second body.

In the preferred embodiment, the first and second rods are coaxial, although this need not variably obtain.

The holding solenoid is adapted to produce a holding force sufficiently high to hold the second armature against the second body so that the first coil may be thereafter de-energized. The second rod may be formed of a low-mass high-strength metallic material. A spacer may be positioned between the second armature and the second body to hold the second armature in spaced relation to the second body when the second armature is held in its extended position.

The control circuit may further include means (55) for delaying the decay of stored magnetic energy in the first solenoid. The first coil may be de-energized as a function of the position of the second rod relative to the second body.

Accordingly, the general object of the invention is to provide an improved quick-return electro-mechanical actuator.

Another object is to provide an improved solenoid mechanism in which a quick-return feature is a function of the low mass of a displaced armature, the high spring rate of a return spring, the presence of a spacer or shim between the second armature and second body, and the particular material of the second rod, all of which contribute to limit the exponential rise of the flux magnitude flux across the air gap as it approaches zero. These last two features permit the magnetic field produced by the second coil to collapse quickly when the second coil is de-energized.

Another object is to provide an improved actuator that is particularly suited for use in securing the cockpit door of a commercial aircraft.

Another object is to provide a cockpit door latching solenoid that offers the capability of a long stroke, and quick release in the event of a sensed-condition, such as cockpit and/or cabin depressurization.

These and other objects and advantages will become apparent from the foregoing and ongoing written specification, the drawings, and the appended claims.

DESCRIPTION OF THE PREFERRED EMBODIMENTS

Figure 1:
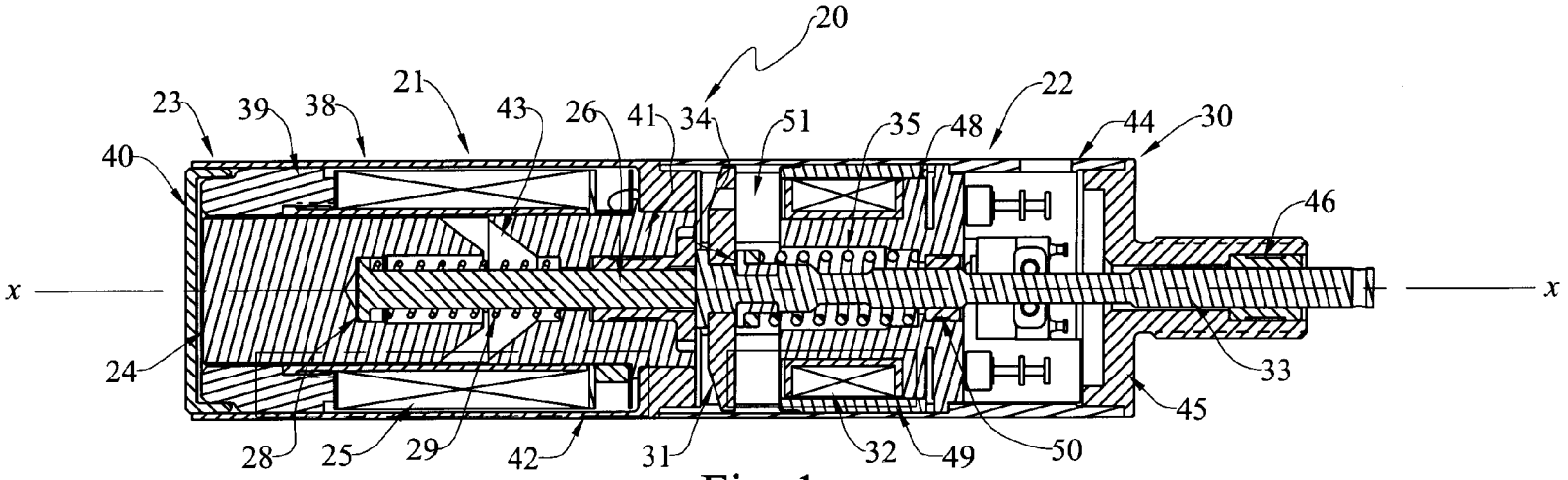
FIG. 1 is a fragmentary vertical sectional view of a presently-preferred form of the improved quick-return electro-mechanical actuator according to the present invention.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e. g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring to the drawings, the present invention broadly provides an improved quick-return electro-mechanical actuator, of which the presently-preferred embodiment is generally indicated at 20.

Figure 2:
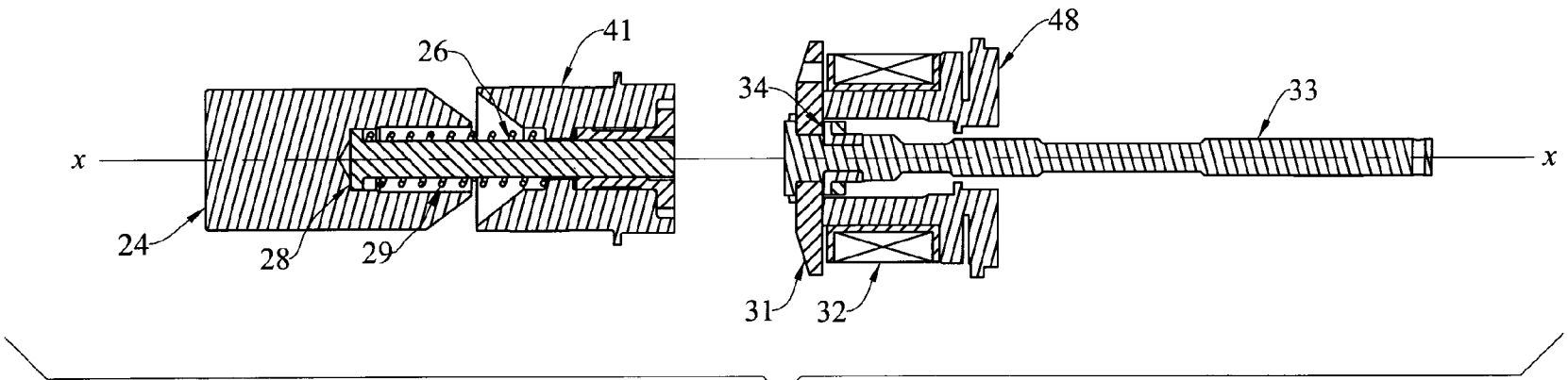
FIG. 2 is a fragmentary vertical sectional view of the first and second rods, together with their associated armatures and portions of their respective bodies, this view showing the leftward first body portion, rod and armature in exploded aligned relation to the rightward second body portion, rod and armature.

As best shown in FIGS. 1 and 2, actuator 20 broadly includes a leftward cocking solenoid, generally indicated at 21, and a rightward holding solenoid, generally indicated at 22.

Figures 3, 4, 5:
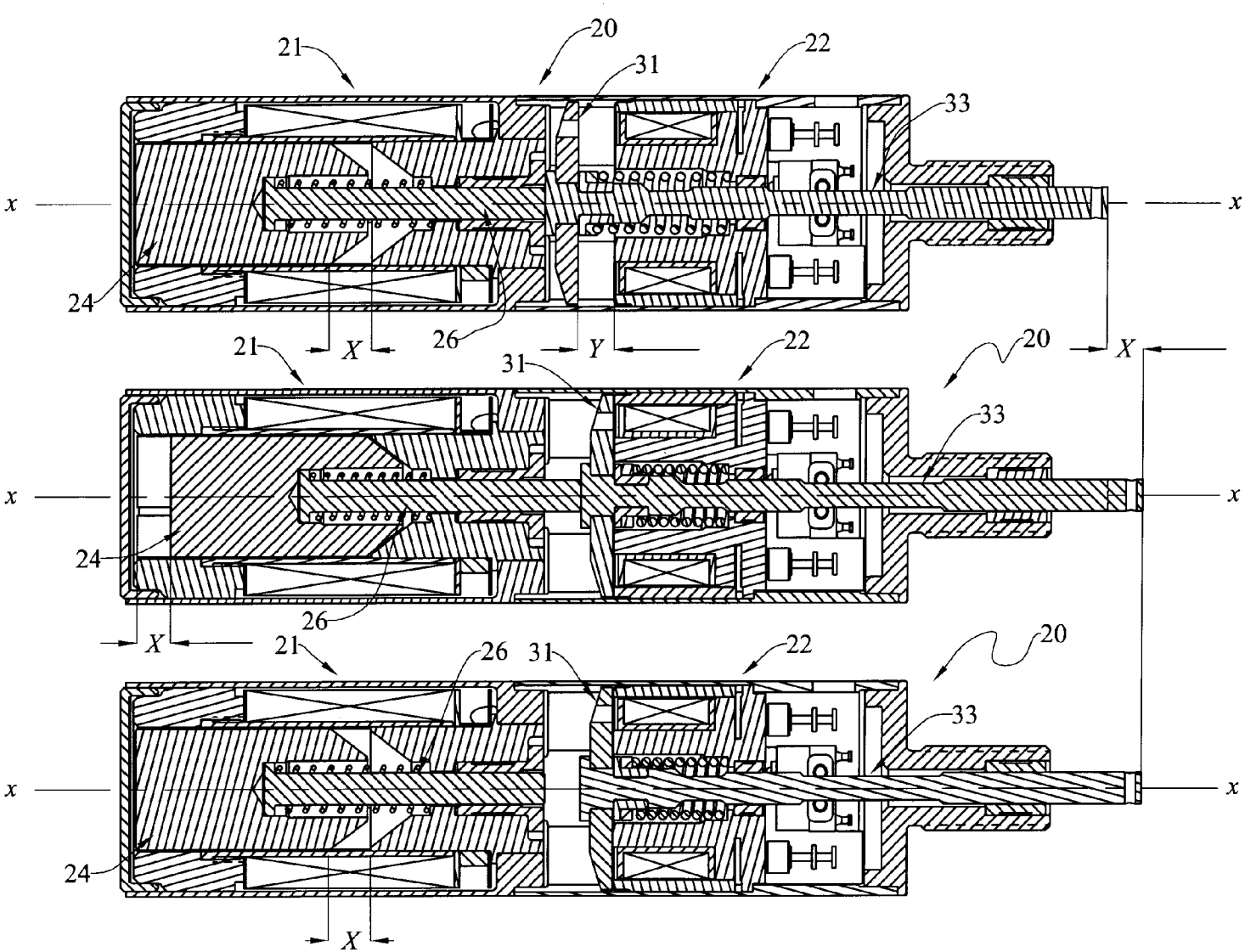
FIG. 3 is a view generally similar to FIG. 1, showing the cocking solenoid as being in its return position and showing the holding solenoid as being in its retracted position.
FIG. 4 is a view generally similar to FIG. 3, but showing the cocking solenoid armature as having been moved to its cocked position, and showing the second rod as having been moved rightwardly to its extended position.
FIG. 5 is a view generally similar to FIG. 4, but showing the first spring as having moved the cocking solenoid armature back to its return position with the holding solenoid holding the second rod in its extended position.

The cocking solenoid broadly includes an assembled first. body, collectively indicated at 23, a first armature 24 movably mounted on the first body, and a first coil 25 mounted on the first body and adapted to be selectively energized to cause the first armature to move from a de-energized or return position (shown in FIGS. 1 and 3) to an energized or cocked position (shown in FIG. 4). The distance of such first armature travel is indicated by dimension X in FIG. 3.

A first rod 26 is movably mounted on the first body. The first rod has a leftwardly-facing annular vertical surface 28 adapted to bear against a complementarily-configured surface on the first armature. A first spring 29 surrounds a portion of the first rod, and is arranged to act between the first rod and the first body for continuously biasing the first rod to move toward the first armature. In the disclosed embodiment, this first spring 29 is simply a coil spring.

Holding solenoid 22 is shown as having a second body, collectively indicated at 30, an annular second armature 31 movably mounted on the second body, and a second coil 32 mounted on the second body and adapted to be selectively energized to cause the second armature to be held in its energized or extended position (shown in FIGS. 4 and 5). The distance of such second armature travel is indicated by distance Y in FIG. 3.

The holding solenoid includes a second rod 33 movably mounted on the second body. The inner margin of the second armature is captured between opposed facing surfaces 34,34' on the second rod. A second spring 35 acts between the second body and the second armature for urging the second rod to move leftwardly relative to the second body to the retracted position.

Figure 6:
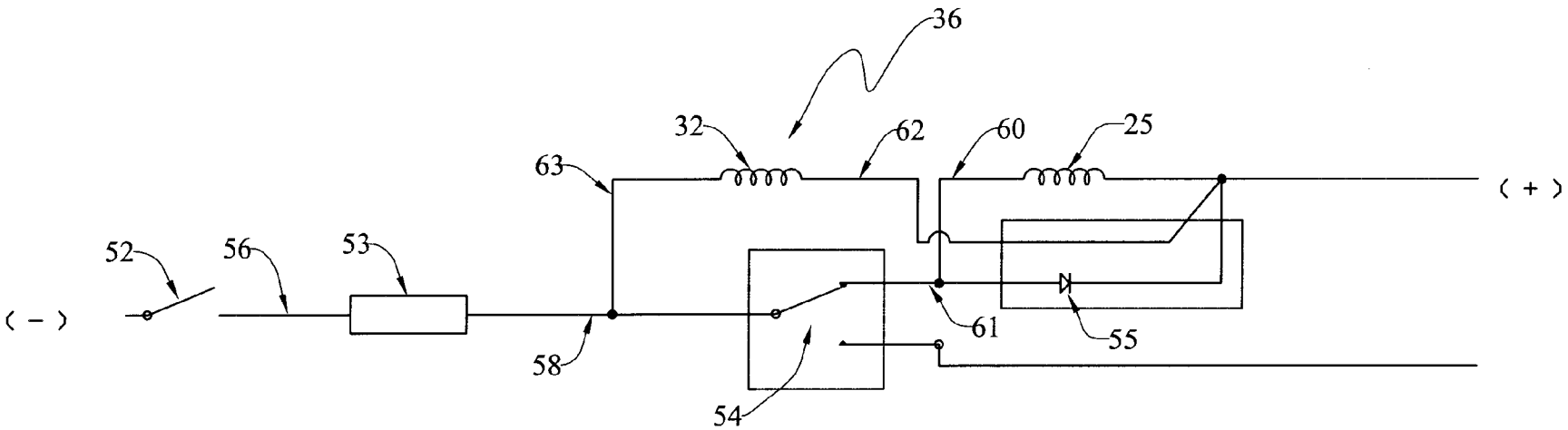
FIG. 6 is an electrical schematic of the control circuit.

As best shown in FIG. 6, the inventive actuator further includes a control circuit, generally indicated at 36, that is selectively operable to energize simultaneously the first and second coils to move the first armature from its return position to its cocked position and for moving the second rod and second armature from the retracted position to the extended position. The first solenoid is de-energized after the second armature has been held in its extended position. This de-energization of the first coil may be accomplished as a function of the position of the second rod relative to the second body by means of a proximity switch 54 (FIG. 6).

Persons skilled in the art will readily appreciate that the improved actuator is elongated along horizontal axis x-x. As clearly shown in FIGS. 2 and 5, the first and second rods are adapted to bear against one another when the solenoids are energized, but may be physically separated when the first solenoid is de-energized. The first body is shown as being an assembly of an outer body part 38, and a leftward guide 39, a leftward-most cup-shaped end cap 40, and a rightward-most specially-configured body portion 41. The first body is formed of a flux-conductive material, and includes a magnetic circuit, indicated by dashed lines 42, that encircles the first coil and that spans a fixed-reluctance radial air gap 43' and a variable-reluctance axial air gap 43. The surfaces of the first body and the first armature that face into air gap 43 are frusto-conical.

The second or holding solenoid also includes an assembled body having an outer part 44, a rightward specially-configured end cap 45 provided with a guide 46, and an inner specially-configured part 48. The assembled holding solenoid body is also formed of a magnetically-conductive material, and has a magnetic circuit, indicated at 49 in FIG. 1, that surrounds the coil. This magnetic circuit is independent of the cocking solenoid magnetic circuit, and includes two variable-reluctance axial air gaps 51,51 arranged in series with one another, but no fixed-reluctance radial air gap.

In the preferred embodiment, the mass of the second armature 31 is substantially less than the mass of the first armature 24, as can be visually seen from the hatching and outline of these respective parts. These masses move rightwardly together when it is desired to extend the second rod. However, as will be discussed infra, after the second rod has been displaced rightwardly and it is desired to hold such rod in its extended position, the first coil is de-energized, and the first spring is permitted to expand to move the first armature leftwardly back toward its return position. This effectively decouples the first mass from the second mass and enables a quick-return of the mechanism when the second coil is selectively de-energized.

The operation of the improved actuator is comparatively illustrated in FIGS. 3–5. FIG. 3 illustrates the condition of the actuator prior to energization. It should be noted that the first and second armatures are in their respective de-energized positions, and that the first and second rods have been moved leftwardly relative to their respective bodies. Hence, the second rod is depicted as being in its de-energized position.

When it is desired to energize or cock the actuator, the first and second coils are initially energized. This moves the first actuator rightwardly until the frusto-conical surfaces on the first armature and first body abut one another. The rightward end of the first rod engages the leftward end of the second rod, and physically displaces the second rod, together with the second armature rightwardly relatively to the body. As the second armature is moved rightwardly relative to the second body, the axial length of air gap 51 decreases, and is ultimately reduced to zero or near-zero when the spacer or shim is interposed between the second armature and second body. Thus, FIG. 4 depicts the apparatus as having been energized, with the second rod having been moved from its de-energized position to its energized position.

As the second rod is displaced rightwardly, the energized second coil holds the second armature tightly against the second body. The magnetic holding force increases exponentially as the second armature moves to close the air gap to zero or near-zero if a spacer or shim is interposed between the second armature and second body. This holds the second rod in its rightwardly-displaced position. The control circuit then de-energizes the first coil since it is no longer necessary to hold the second rod in its displaced position. When the first coil is de-energized, the first spring expands to move the first armature from its energized position, as shown in FIG. 4, back to its de-energized position, as shown in FIG. 5. At the same time, the first rod moves leftwardly with the first armature, and physically separates from the second rod. Thus, the mass of the first armature and the first rod is effectively separated from the mass of the second armature and second rod. Hence, in the event of a demanded retraction (e.g., a sensed-condition, such as cockpit and/or cabin depressurization), the second spring, which has a spring rate substantially greater than that of the first spring, will quickly move the reduced mass of the rightwardly-held holding solenoid leftwardly relative to its body.

FIG. 6 is a schematic of the control circuit 36. This control circuit is shown as broadly including a switch 52 responsive to an external demand, signal or event, a thermal fuse 53, a position-dependent switch 54 movable between open and closed positions, a diode 55, the first coil 25 and the second coil 32. The switch 52 is shown as being connected to the thermal fuse by means of a conductor 56. Switch 52 is normally closed, until its is opened to de-energize coil 32. The thermal fuse is connected to switch 54 via a conductor 58. The first coil 25 communicates with a positive current source via conductor 59, and also communicates via conductor 60 with a conductor 61 acting between the closed pole of the switch and diode 55. Conductor 62 communicates one side of the second coil with conductor 59. Another conductor 63 communicates the other side of second coil 32 with conductor 58. The function of the diode in the circuit is to provide a means for delaying the decay of stored magnetic energy in the first coil when the cocking solenoid is de-energized so that the return speed of the first armature is slowed to a desirable rate.

Of course, in the event of an external demand, switch 52 opens to allow the quick-return of the rightwardly-displaced second rod.

Therefore, when the second coil is de-energized, the second spring will expand to quickly move the second rod from its energized position toward its de-energized position. This is permitted by the antecedent decoupling of the masses of the first rod and first armature from the second rod and second armature, which effectively reduces the inertia of the mass that must be accelerated leftwardly when the second spring expands.

The function of the thermal fuse is to provide a safety feature such that if there is overheating for any reason, the fuse will open and the second rod will be left in the "safe" or retracted position.

Modifications

The present invention contemplates that many changes and modifications made be made. For example, the specific elements and arrangement of the control circuit may readily be changed or varied as necessary. If desired, delay-creating diode may be eliminated, or other circuitry for delaying or attenuating an electrical signal may be substituted therefor to either speed up or slow down the return speed of the first rod.

Another modification that will enhance the speed of the retraction of the second rod is to reduce the magnetic resistence caused by the magnetic field breakdown while the rod is moving through the field. This may be accomplished by making the second armature and solenoid body from a low-coersive intensity iron that will reduce the magnetic resistence to the magnetic field breakdown. The inductance of the second coil may be optimized to the lowest possible magnitude, while still providing sufficient force for a given current to hold the second rod with the second spring compressed.

The inclusion of a spacer or shim to limit the air gap 51 when the second armature moves rightwardly, will limit the maximum force developed by the hold solenoid. Because the relationship between air gap length and flux is exponential, a small-length shim or spacer result in large decrease in flux magnitude. Since the objective is the develop only sufficient force to restrain the second rod while compressing the second spring, and to collapse the developed magnetic field as rapidly as possible upon retraction, the length of the shim or spacer should be no more than needed to provide an acceptably safe margin above the spring force. Also, the second rod may be made from a low-mass high-strength material, such as titanium, to improve the dynamic response of the mass-spring system formed by the second spring, second rod and second armature. The combination of low mass and high spring rate can be matched to form the optimal rigid body dynamics. These can be taken in conjunction with the dynamics of the second coil magnetic field breakdown rate to meet the intended high retraction rate.

With respect to the structure of the improved actuator, while the present arrangement affords a compact package, other structural arrangements might be readily substituted therefore. In the preferred embodiment, the various parts are generally coaxial, having been generated about axis x-x. However, in some alternative arrangement, these parts could be arranged differently, as desired. There could be multiple coils in place of first coil 25 and second coil 32, as might occur if redundancy was desired. The structural arrangement may be symmetric about the x-x axis, or it may be rectangular or square. The first rod may be formed integrally with the first armature. Similarly, the second rod may be formed integrally with the second armature, as desired.

Therefore, while the presently-preferred form of the improved actuator has been shown and described, and several modifications thereof discussed, persons skilled in this art will readily appreciate that various additional changes and modifications may be made without departing from the spirit of the invention, as defined and differentiated by the following claims.

What is claimed is:

1. A quick-return electro-mechanical actuator, comprising:

a cocking solenoid having a first body, a first armature movably mounted on said first body and a first coil mounted on said first body and adapted to be selectively energized to cause said first armature to move between return and cocked positions;

a first rod movably mounted on said first body for movement with said first armature;

a first spring operatively arranged to urge said first armature and said first rod toward said return position;

a holding solenoid having a second body, a second armature movably mounted on said second body for movement between retracted and extended positions and a second coil mounted on the second body and adapted to be selectively energized to hold said second armature in its extended position;

a second rod mounted on said second body for movement with said second armature, and wherein said first armature and said first rod are so configured and arranged as to displace said second armature and said second rod from said retracted position to said extended position when said first armature is moved from its return position to its cocked position;

a second spring operatively arranged to urge said second rod and said second armature to move toward said retracted position; and a control circuit selectively operable to energize said first and second coils to move said first armature to its cocked position and to move said second armature to its extended position, and to de-energize said first coil when said second armature is held in said energized position;

whereby, when said first coil is de-energized, said second armature will be held in said extended position, said first spring may expand to move said first armature back toward its return position such that the mass of said second armature will be separated from the mass of said first armature so that when said second coil is subsequently de-energized, said second spring will expand to quickly move said second rod from its extended position toward its retracted position.

2. An electro-mechanical actuator as set forth in claim 1 wherein said cocking and holding solenoids are structurally different so as to adapt each to its stated function.

3. An electro-mechanical actuator as set forth in claim 1 wherein said cocking solenoid has a magnetic circuit that includes a fixed-reluctance radial air gap and a variable-reluctance axial air gap arranged in series with one another.

4. An electro-mechanical actuator as set forth in claim 3 wherein said axial air gap is frusto-conical.

5. An electro-mechanical actuator as set forth in claim 1 wherein said holding solenoid has a magnetic circuit that includes two variable-reluctance axial air gaps arranged in series with one another.

6. An electro-mechanical actuator as set forth in claim 5 wherein said holding solenoid magnetic circuit does not include a fixed-reluctance air gap.

7. An electro-mechanical actuator as set forth in claim 1 wherein the mass of said first armature is greater than the mass of said second armature.

8. An electro-mechanical actuator as set forth in claim 1 wherein the spring rate of said second spring is greater than the spring rate of said first spring.

9. An electro-mechanical actuator as set forth in claim 1 wherein said first body has a surface that functions a stop for movement of said first armature.

10. An electro-mechanical actuator as set forth in claim 1 wherein said first and second rods are coaxial.

11. An electro-mechanical actuator as set forth in claim 1 wherein the magnetic circuit of said cocking solenoid is independent of the magnetic circuit of said holding solenoid.

12. An electro-mechanical actuator as set forth in claim 1 wherein said holding solenoid is adapted to produce a holding force sufficiently high to hold said second armature against said second body when said second coil is energized.

13. An electro-mechanical actuator as set forth in claim 1 wherein said second shaft is formed of a low-mass high-strength metallic material.

14. An electro-mechanical actuator as set forth in claim 1 wherein said second armature and said second body are formed of a low-coercive intensity iron.

15. An electro-mechanical actuator as set forth in claim 1 and further comprising a spacer positioned between said second armature and said second body to hold said second armature in spaced relation to said second body when said second armature is held in said extended position.

16. An electro-mechanical actuator as set forth in claim 1 wherein said first coil is de-energized as a function of the position of said second rod relative to said second body.

17. An electro-mechanical actuator as set forth in claim 1 wherein said control circuit includes means for delaying the decay of stored magnetic energy in said first coil when said cocking solenoid is de-energized.

18. A quick-return electro-mechanical actuator, comprising:

an actuating member having a range of motion between a retracted position and an extended position;

a return spring operatively arranged to urge said actuating member toward said retracted position;

a cocking solenoid selectively energizable to move said actuating member from its retracted position to its extended position;

a unidirectional coupling between said cocking solenoid and said actuating member for urging said cocking solenoid to separate from said actuating member when said cocking solenoid is de-energized so as to subsequently allow independent motion of said actuating member; and a holding solenoid selectively energizable to hold said actuating member in said extended position after said cocking solenoid has been de-energized and said cocking solenoid has separated from said actuating member such that said return spring may quickly accelerate said actuating member from said extended position toward said re-tracted position without any further displacement of said cocking solenoid or said coupling when said holding solenoid is subsequently de-energized.

* * * * *